US005887472A

United States Patent [19]

Abbey, III

[11] Patent Number: 5,887,472

[45] Date of Patent: Mar. 30, 1999

[54] TOOLING CHANGEOVER FOR TUBE MILLS

[75] Inventor: Nelson D. Abbey, III, Perrysburg, Ohio

[73] Assignee: Abbey Etna Machine Company, Perrysburg, Ohio

[21] Appl. No.: 880,787

[22] Filed: Jun. 23, 1997

[51] Int. Cl.[6] ..... B21B 31/07; B21B 31/08

[52] U.S. Cl. ..... 72/238; 72/239

[58] Field of Search ..... 72/239, 238, 235, 72/237

[56] References Cited

U.S. PATENT DOCUMENTS

| | | | |
|---|---|---|---|
| 3,323,341 | 6/1967 | Chang | 72/178 |
| 3,472,053 | 10/1969 | Chang . | |
| 3,583,195 | 6/1971 | Sherwood | 72/237 |
| 3,665,746 | 5/1972 | Eibe . | |
| 4,222,258 | 9/1980 | Field | 72/239 |
| 4,435,970 | 3/1984 | Sekiya . | |
| 4,653,304 | 3/1987 | Feldmann et al. | 72/239 |
| 4,724,695 | 2/1988 | Stoehr . | |
| 5,016,806 | 5/1991 | Yapp . | |
| 5,085,067 | 2/1992 | Reismann et al. | 72/247 |
| 5,095,728 | 3/1992 | Poloni . | |
| 5,107,695 | 4/1992 | Vandenbroucke . | |
| 5,461,896 | 10/1995 | Abbey, III et al. | 72/239 |
| 5,600,988 | 2/1997 | Abbey, III . | |
| 5,720,195 | 11/1995 | Ruple | 72/238 |

FOREIGN PATENT DOCUMENTS

| | | |
|---|---|---|
| 0036322 | 8/1990 | Japan . |

*Primary Examiner*—Joseph J. Hail, III
*Assistant Examiner*—Rodney Butler
*Attorney, Agent, or Firm*—Donald R. Fraser

[57] ABSTRACT

A continuous tube mill apparatus for changeover production of a first product to production of a second product of a different size or shape which includes a tube forming section having a stationary section and a removable cassette. The stationary section includes a pair of horizontally disposed spaced apart forming roll receiving spindles. The removable cassette includes a cradle, a first pair of forming rolls for disposition on respective spindles and a pair of side forming rolls cooperating with the first mentioned forming rolls. Means are provided for moving the cradle and the first pair of forming rolls into and out of engagement with the spindles.

14 Claims, 2 Drawing Sheets

TOOLING CHANGEOVER FOR TUBE MILLS

BACKGROUND OF THE INVENTION

1. Field of the Invention

The present invention relates generally to a mill for the production of continuous seam-welded tubes or pipes and, more particularly, to a system for changing such a mill from the production of tubes of one size or shape of tube to the production of tubes of another and different size or shape.

2. Description of the Prior Art

In accordance with a well known process for producing seam-welded tubes, a continuous strip or skelp is advanced through forming sections of a tube mill apparatus which includes a series of forming rolls. The strip is formed into a tubular form having an open, longitudinally extending seam formed by the abutting edges of strip being formed. The tubular form is then advanced through a welding section wherein the abutting edges are urged together and joined by a suitable welding process. The welding process may cause the formation of an unwanted bead which may next be removed by a suitable scarfing procedure. The welded tube is then after passing through a cooling zone, advanced through a series of sizing and squaring rollers whereby the tube is formed to the final configuration and size. The advancing continuous tube is then severed by means of a travelling cutting unit into individual sections of a predetermined length.

The tube forming apparatus is designed to be capable of conversion to the production of various sizes and cross-sectional configurations of tube. As will be readily manifest, such apparatus constitutes massive precision machines representing a considerable investment of capital. Heretofore, it was often necessary to shut down a production of tubes of one size or shape to convert the apparatus to produce tubes of a different size or shape. More specifically, the line was shut down and the various components were individually removed and replaced by components required for production of the next product. The replacement components then had to be properly set and adjusted on the line before production could resume. The entire changeover routine could consume a considerable period of time, as much as five or six hours or more. obviously, the changeover time involves a considerable expenditure in time and capital, and an extensive loss of production. As a result, it becomes necessary to maintain unduly large inventories of finished products, contrary to the current trend toward maintaining minimum inventory and frequently changing from the production of one product to another.

The aforementioned deficiencies were overcome by producing a tube mill of the type illustrated and described in U.S. Pat. No. 5,600,988 Nelson D. Abbey, III et al. The apparatus utilized in the aforementioned patent includes an automated procedure for exchanging components of the mill sections to change from production of tubes of one size or shape to the production of tubes of another and different size or shape. The stand assemblies of the mill to be changed during the changeover procedure are mounted on removable sub-base sections adapted to be carried on a fixed mill base. The stand assemblies and associated subbase may be removed from the fixed mill base and transferred to a remote wash station and thence to an off-line changeover location adjacent a secondary storage cart.

An automatically operated pressure fluid activated push-pull module pulls the front stand onto the secondary storage cart for temporary removal to a temporary storage area.

Simultaneously, another secondary cart carrying empty roll racks is positioned along the roll stand assembly adjacent the exposed forming rolls and associated spacers. The push-pull module pushes the roll rack toward forming rolls and roll manipulators push the rolls and spacers onto the empty roll rack. The secondary storage cart carrying the removed forming rolls is moved to another position away from the stand assembly and eventually to a remote forming roll storage area. Another secondary storage cart with roll racks carrying the changeover rolls is indexed adjacent the roll stand assembly and the push-pull module pushes the roll rack toward the roll stand allowing the roll manipulators to be actuated to engage and pull the new forming rolls onto the roll stand assembly. The secondary cart with the emptied roll racks is moved toward the secondary forming roll storage cart exposing the newly positioned forming rolls.

The secondary front stand storage cart is indexed adjacent the roll stand assembly with the newly positioned forming rolls and the front stands are pushed into engagement with the roll stands and secured in place preparatory to being returned to the mill section for operation.

It will be appreciated that the advantages of a tube mill of the type alluded to above include less down time of the mill even for relatively short production runs.

The continuous tube mill incorporating the above concepts enables preventative maintenance and cleaning of the forming roll assemblies to be easily accomplished without disruption of production.

Since each of the primary sections of the mill are effectively independent of the other, each section may be of differing sophistication without adversely affecting the overall mill operation.

In most instances in the changeover systems of the prior art, the changeover modules include the forming rolls, the associated bearing blocks, the supporting spindles, and the adjustment mechanism. The transportation of particularly the spindles exposes the bearing surfaces to dirt, dust, and grime that tends to decrease the effective life cycle of the equipment. The cost of each module is considerably high. This is a result of the fact that each module is for all intents and purposes a complete forming station.

SUMMARY OF THE INVENTION

In accordance with the present invention, the aforementioned problems can be readily overcome while producing a mill changeover having all of the advantages of the prior art systems at lower equipment and maintenance costs.

The objectives and advantages of the invention are achieved by a tube mill apparatus for changeover production of a first product to production of a second product of a different size or shape, the tube mill including a tube forming section including a plurality of stand assemblies adapted to receive forming roll sets for producing a selected size and shape of tubing at least one of the stand assemblies comprising:

a stationary section including:

a) a base b) a rear stand mounted on the base, the rear stand including a pair of upstanding spaced apart frame members;

c) a pair of horizontally disposed spindles;

d) first bearing means mounted in the pair of frame members of the rear stand and rotatingly supporting respective one of the spindles; and a removable cassette including:

a) a cradle;

b) a lower forming roll removably disposed on the cradle;

c) a front lower bearing assembly supported by the cradle and coaxially aligned with the lower forming roll;

d) a front side roll assembly mounted on the lower bearing assembly;

e) a rear side roll assembly f) an upper forming roll removably supported by the front and rear side roll assemblies;

g) a front upper bearing assembly supported by the front side roll assembly and coaxially aligned with the upper forming roll; and h) means for moving the cradle toward and away from the base to cause the indexing of the lower forming roll and the upper forming roll in respect of respective one of the spindles.

BRIEF DESCRIPTION OF THE DRAWINGS

The above objects and advantages of the invention will become readily apparent to those skilled in the art from reading the following detailed description of the invention when considered in the light of the accompanying drawings, in which.

DETAILED DESCRIPTION OF THE PREFERRED EMBODIMENT

Figure 1:
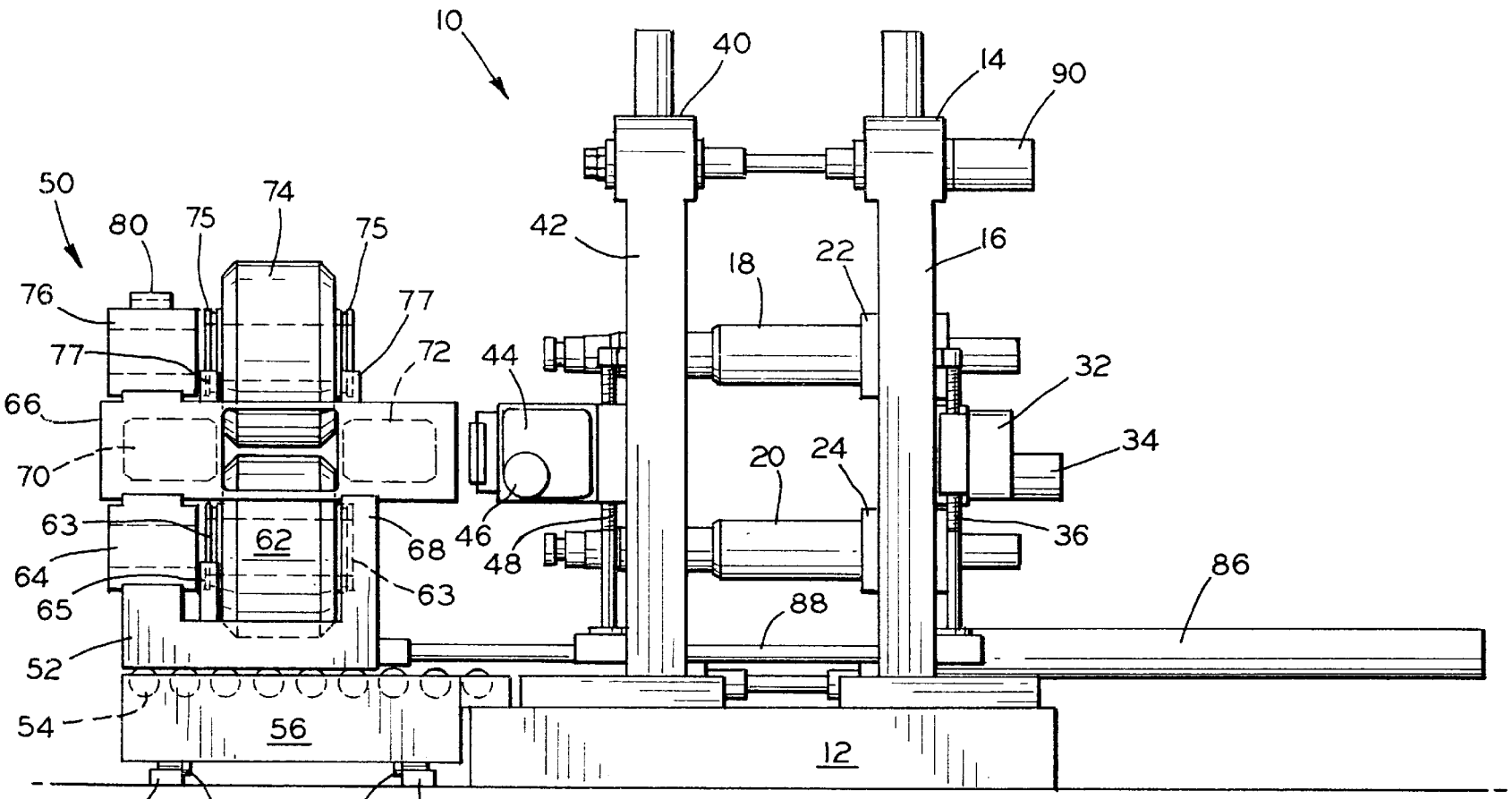
FIG. 1 is an elevational view of a forming section of a tube mill incorporating the features of the invention taken with a forming section and viewing the same toward the outlet end of the mill illustrating a set of forming position rolls removed from operative.

With reference to the drawings, there is shown an automated tube with changeover system embodying the present invention. In tube mills of the type the invention is utilized, a metal strip or skelp is continuously withdrawn from a supply (not shown) and advanced successively through a forming section to produce a continuous seam-welded metal tube or pipe. Thereafter, the finished tube or pipe is separated into individual segments of predetermined length. Such forming sections are conventional and are illustrated and described in more detail in U.S. Pat. Nos. 5,148,960 and 5,192,013, for example.

A typical forming section comprises a series of forming stand assemblies containing cooperating opposed driven breakdown rolls and side cluster units of forming rolls. It will be understood, the forming section through which the strip to be formed into a tubular shape is caused to pass utilize various types of forming elements or rollers which are limited to the production of one particular diameter or type of tube. The tube after being formed is caused to pass through a welding section and thence is conveyed through a cooling section by Vee-type rollers capable of conveying tubes of different diameters and shapes. Whenever the mill is converted from the production of tubing of one diameter or type to another, it is necessary to change the tooling of each of the individual units in at least the forming section. Heretofore, each of these units has been affixed to subbases, adapted to be removably affixed to a permanent mill base. To effect changeover, the entire forming section is simultaneously removed and replaced by another forming section of the size to produce the desired size tubing.

In accordance with the present invention, only selected portions of the forming section are removed and replaced, thereby reducing the overall costs as will be explained.

The illustrated forming section of the illustrated tube mill consists of a stationary section 10 which includes a fixed base 12 supporting rear stand 14 mounted on the base 12. The rear stand 14 includes a pair of spaced apart upstanding frame members 16. An upper spindle 18 and a lower spindle 20 are journalled within respective bearing blocks 22, 24, which, in turn are mounted for selective vertical movement. Typically, the spindles 18, 20 are drivingly connected to a source power through suitable drive shafts.

Rear side roll supporting and adjusting means, including a gear box and a drive motor 34, is mounted for selective vertical movement on a lead screw 36.

A front stand 40 is mounted on the base 12. The front stand 40 includes a pair of spaced apart upstanding frame members 42.

Front side roll supporting and adjusting mechanism, including a gear box 44 and a drive motor 46, is mounted for selective vertical movement on a lead screw 48. Further, the front side roll adjusting means is mounted for swinging movement about the vertical axis of the lead screw 48.

With the equipment in the position illustrated in the drawing and most particularly in FIG. 1, the front side roll adjusting means is in a position to enable access of an associated removable cassette 50. The cassette 50 includes a cradle 52 adapted to be supported by a series of rollers 54 rotatably mounted in a moveable cart 56 which, in turn, is mounted to move on spaced tracks 58 by track engaging wheels 60. The tracks 58 typically lead to a remote storage area where other substitute cart members are staged for quick selection based upon tube size or shape to be produced by the associated mill.

The cradle 52 is adapted to carry a lower forming roll 62 and an associated bearing block 64 so as to be aligned with and fit on the lower spindle 20. More specifically, the forming roll 62 is provided with annular extensions 63 which extend axially from the opposite side surfaces of the roll. The extensions 63 are adapted to rest within suitably formed saddles 65 formed in the cradle 52.

A side roll intermediate housing 66 is carried on and supported by the uppermost surface of the lower bearing block 64 and an upstanding portion 68 of the cradle 52. The housing 66 is formed to rotatingly contain a pair of spaced apart front and rear side forming rolls 70 and 72, respectively. The side forming rolls 70 and 72 rotate about vertical axes and are movable toward and away from opposite sides of the upper and lower rolls.

An upper forming roll 74 and an associated bearing block 76 are carried on and supported by the intermediate housing 66.

It will be noted that the upper forming roll 74 is provided with annular extensions 75 which extend axially from the opposite side surfaces of the roll. The extensions 75 are adapted to rest within suitably aligned and spaced apart saddles 77 formed in the upper surface of the housing 66. In the supported position, the upper forming roll 74 and the bearing block 76 are in alignment with the upper spindle 18, and the peripheral outer forming surface of the roll 74 is slightly spaced from the peripheral outer forming surface of the cooperating lower roll 62. The spacing will insure that the forming surfaces of the rolls 62 and 74 do not contact one another to cause any undesirable scoring, gouging, or the like during the changeover procedure.

A lifting bracket 80 is suitably affixed to the upper surface of the upper bearing block 66 as by welding, for example. The bracket 80 is provided with a longitudinally extending slot which cooperates with the internal portion of the bracket 80 to receive a lifting rail member 82 which is secured to the distal end of a lifting said screw 84 for sliding engagement within the slot.

A pressure fluid operated motor 86 having an extendable and retractable piston rod 88 is connected to the cradle 52 of the cassette 50.

In the operation of the apparatus thus far described and illustrated, it is assumed that the stationary section 10 is ready to receive a roll set for the production of a particular size or shape of tubing and, further that a previous roll set has been removed and carried to a remote storage zone.

Figure 2:
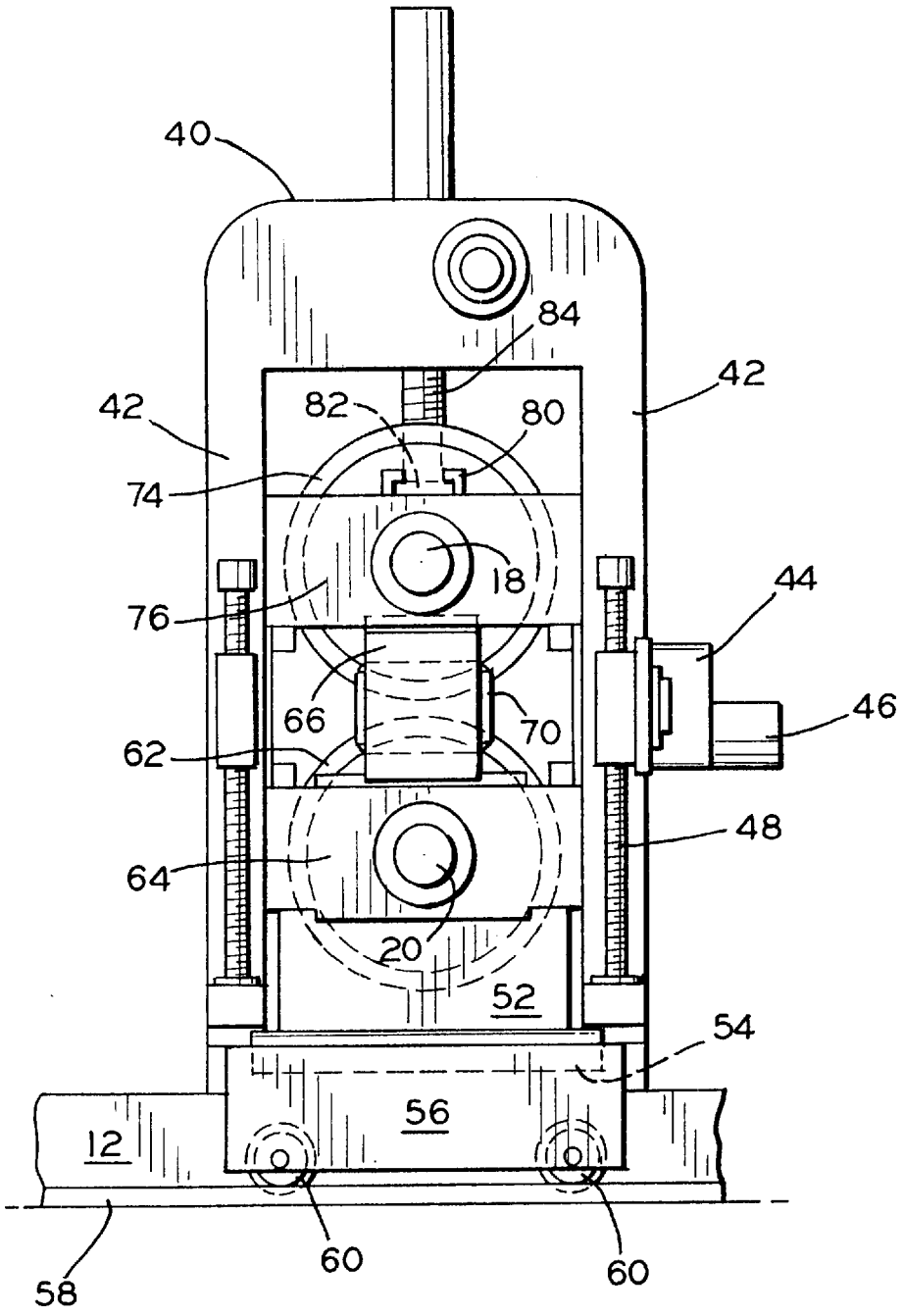
FIG. 2 is a side elevational view of the forming section illustrated in FIG. 1.

Initially, the movable cart 56, carrying the cradle 52 and associated forming rolls, as rather clearly illustrated in FIG. 1, is moved to the position illustrated in FIGS. 1 and 2. In this position, the upper forming roll 74 and associated bearing block 76 and the lower forming roll 62 and associated bearing block 64 are in axial alignment with the longitudinal axes of the upper spindle 18 and the lower spindle 20. The gear box 44 and drive motor 46 are in an outwardly pivoted position, thereby providing clear access for the unimpaired inward movement of the cassette 50.

The cradle 52 is suitably coupled to the distal end of the extensible rod 88. The pressure fluid motor 86 is then energized causing the rod 88 to retract inwardly of the motor 86 causing the cassette 50 to move toward the front stand 42 of the stationary section 10 over the rollers 54. The inward movement continues until the upper spindle 18 and the lower spindle 20 are inserted within the interior of the upper forming roll 74 and associated bearing block 76 and the lower forming roll 62 and associated bearing block 64, respectively.

Also, the rear side forming roll 72 becomes drivingly connected to the rear gear box 32. The front gear box 44 is then pivoted and latched into driving connection with the front side forming roll 70.

At this stage, the front side roll adjusting mechanism, including the gear box 44 and the drive motor 46, is suitably pivoted into a locked operative position. The upper roll spindle 18, the front bearing block 76, and the rear bearing block 22 are raised to the desired operating level by suitable control mechanism associated with the front stand 42 and the rear stand 16 which mechanism includes a control motor 90.

The side roll intermediate housing 66 is raised to an operative position from its resting position on the front bearing block 64 and the upstanding portion 68 of the cradle 52.

Finally, the lower roll spindle 20, the front bearing block 64, and the rear bearing block 24 are raised to the desired operating level by the control mechanism.

When the forming rolls are in the desired operating level, the nuts securing the forming rolls 74, 62 to the respective spindles 18, 20 are reinstalled and tightened.

The drive motors 46 and 34 of the front and side roll adjusting mechanism are actuated to cause in or out movement of the associated side forming rolls 70 and 72, respectively, dependent upon the thickness of the metal being formed.

The illustrated forming section is now ready for mill operation.

While the above described forming section is typically referred to as the squaring section of the mill, it will be understood that the invention may be advantageously employed in other sections of the mill including the breakdown, fin-pass and sizing sections.

It will further be understood at the end of a production run when it is desired to produce a tubing of a different size and/or shape, the above procedure is reversed to disassemble the movable cassette 50 from the stationary section 10. And thence a new cassette would be moved into appropriate position and the loading operational sequence would be repeated.

From the foregoing description it will be appreciated that optimum changeover times are achieved through the use of the described mechanism. Through the use of the invention, it is necessary to effect changeover to merely remove and replace the upper and lower forming rolls; the bearing blocks for journalling the front of the roll supporting spindles; and the side forming rolls. The remainder of the mechanism remains in place in the front and rear stands 40,14, respectively. More specifically, the present invention makes possible the use of nonchangeable spindles and spindle bearing blocks for the rear stand, thereby reducing the overall costs.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A continuous tube mill apparatus for changeover production of a first product to production of a second product of a different size or shape, the tube mill including a tube forming section including a plurality of stand assemblies arranged to receive forming roll sets for producing a selected size and shape of tubing at least one of the stand assemblies comprising:

a stationary section including a) a base b) a rear stand mounted on said base, said rear stand including a pair of upstanding spaced apart frame members;

c) a pair of horizontally disposed spindles; and d) first bearing means mounted in the pair of frame members of said rear stand and rotatingly supporting respective one of said spindles; and a removable cassette including a) a cradle;

b) a lower forming roll removably disposed on said cradle;

c) a front lower bearing assembly supported by said cradle and coaxially aligned with said lower forming roll;

d) a front side roll assembly;

e) a rear side roll assembly;

f) a housing rotatingly containing said front side roll assembly and said rear side roll assembly and mounted on said lower bearing assembly and said cradle:

g) an upper forming roll removably supported by said front and rear side roll assemblies;

h) a front upper bearing assembly supportable by said front side roll assembly and coaxially aligned with said upper forming roll; and i) means for moving said cradle toward and away from said base to cause the indexing of said lower forming roll and said upper forming roll in respect of respective one of said spindles.

2. A continuous tube mill apparatus for changeover production of a first product to production of a second product of a different size or shape, the tube mill including a tube forming section including a plurality of stand assemblies arranged to receive forming roll sets for producing a selected size and shape of tubing, each of the stand assemblies comprising:

a fixed base a frame mounted on said base, said frame including a pair of upstanding spaced apart frame members;

at least a pair of horizontally disposed spaced apart spindles;

first bearing means mounted in one of said pair of frame members for rotatingly supporting one end of respective one of said spindles;

second bearing means mounted for selective movement into and out of rotatingly supportive relation of the opposite end of respective one of said spindles;

a first set of forming rolls receivable on said spindles;

a second set of forming rolls cooperating with said first set of forming rolls said second set including a housing rotatingly containing said second set of forming rolls to rotate about vertical axes;

a movable cart;

a cradle mounted on said cart, said cradle arranged to support said second bearing means, said first set of forming rolls, and said second set of forming rolls including the housing containing said second set of forming rolls; and means for moving said cradle relative to said cart to cause said first set of forming rolls to be received on respective one of said spindles, for moving said second bearings into rotatingly supportive relative with respective one of said spindles, and for moving said second set of forming rolls into operative position with respect to said frame.

3. A continuous tube mill apparatus as defined in claim 2 including means for selectively horizontally adjusting of the forming rolls of said second set toward and away from one another.

4. A continuous tube mill apparatus as defined in claim 3 including means for horizontally adjusting said second set of forming rolls within the housing.

5. A continuous tube mill apparatus as defined in claim 2 wherein said first set of forming rolls includes an upper forming roll and a lower forming roll.

6. A continuous tube mill apparatus as defined in claim 2 including saddle brackets mounted on said housing for supporting upper forming roll.

7. A continuous tube mill apparatus as defined in claim 2 wherein said second bearing means for said upper spindle is mounted on said housing.

8. A continuous tube mill apparatus as defined in claim 3 including means for selectively vertically adjusting said horizontally disposed spindles.

9. A continuous tube mill apparatus as defined in claim 4 wherein said means for horizontally adjusting includes a motor and gear arrangement.

10. A continuous tube mill apparatus as defined in claim 4 wherein said means for horizontally adjusting includes at least one support pivotally connected to one of said frame members.

11. A continuous tube mill apparatus as defined in claim 10 wherein said support is vertically adjustable.

12. A continuous tube mill apparatus as defined in claim 11 wherein said support is vertically adjustable on a lead screw.

13. A continuous tube mill apparatus as defined in claim 5 wherein said cradle includes saddle brackets for supporting said lower forming roll.

14. A continuous tube mill apparatus as defined in claim 13 wherein saddle brackets for supporting said upper forming roll are disposed on the housing containing said second set of forming rolls.

* * * * *